US007188617B1

(12) United States Patent
O'Blenes

(10) Patent No.: US 7,188,617 B1
(45) Date of Patent: Mar. 13, 2007

(54) CONVERTIBLE PORTABLE COOKER

(76) Inventor: Warren E. O'Blenes, 44 Lancaster St., Quincy, MA (US) 02169

( * ) Notice: Subject to any disclaimer, the term of this patent is extended or adjusted under 35 U.S.C. 154(b) by 44 days.

(21) Appl. No.: 10/861,204

(22) Filed: Jun. 4, 2004

Related U.S. Application Data

(60) Provisional application No. 60/475,416, filed on Jun. 4, 2003.

(51) Int. Cl.
*F24C 3/14* (2006.01)

(52) U.S. Cl. ..... 126/25 R; 126/40; 126/9 R; 126/24; 99/340

(58) Field of Classification Search ..... 126/39 R, 126/9 R, 25 R, 41 R, 38, 40, 50, 24, 304 A, 126/304 R; 99/447, 450, 340
See application file for complete search history.

(56) References Cited

U.S. PATENT DOCUMENTS

| | | | | |
|---|---|---|---|---|
| 284,295 | A | 9/1883 | Hailes | |
| 1,284,299 | A | 11/1918 | Freeon | |
| 2,477,529 | A | 7/1949 | Sprinkle et al. | |
| 2,515,521 | A * | 7/1950 | Loffredo | 126/304 A |
| 3,032,783 | A | 5/1962 | Swanson, Jr. | |
| 3,094,113 | A * | 6/1963 | Avila | 126/30 |
| 3,593,647 | A | 7/1971 | Copeland, Jr. | |
| 3,791,368 | A | 2/1974 | Hunt | |
| 4,681,083 | A | 7/1987 | Shu | |
| 4,686,958 | A | 8/1987 | Skelton et al. | |
| 4,729,535 | A | 3/1988 | Frazier et al. | |
| 4,909,235 | A | 3/1990 | Boetcker | |
| 4,922,887 | A | 5/1990 | Foxford | |
| 4,944,284 | A | 7/1990 | O'Quin | |
| 5,009,380 | A | 4/1991 | Fee | |
| 5,033,448 | A * | 7/1991 | Sandweg | 126/25 R |
| 5,179,932 | A | 1/1993 | DeCarlo | |
| 5,411,011 | A | 5/1995 | Teta | |
| 5,413,087 | A | 5/1995 | Jean | |
| 5,575,195 | A * | 11/1996 | Foxford | 126/9 R |
| 5,797,386 | A | 8/1998 | Orr | |
| 6,105,487 | A | 8/2000 | Nash et al. | |
| 6,125,838 | A | 10/2000 | Hedgpeth | |
| 6,314,955 | B1 | 11/2001 | Boetcker | |
| 6,422,231 | B1 * | 7/2002 | Hamilton et al. | 126/38 |

FOREIGN PATENT DOCUMENTS

| | | |
|---|---|---|
| WO | WO 98/15218 | * 4/1998 |

* cited by examiner

*Primary Examiner*—Josiah C. Cocks
(74) *Attorney, Agent, or Firm*—John P. McGonagle

(57) ABSTRACT

A portable outdoor cooker particularly adapted for boats and convertible for grill, griddle, steam and roast cooking. A cooker unit having an open top and a propane gas log interiorly positioned and attached to a propane supply is provided. Various racks and pans and covers are mounted on the cooker providing the ability to grill, griddle, steam or roast. The cooker has removable or retractable legs for mounting on boat rails.

1 Claim, 5 Drawing Sheets

CONVERTIBLE PORTABLE COOKER

CROSS-REFERENCE TO RELATED APPLICATIONS

Applicant claims the priority benefits of U.S. Provisional Patent Application No. 60/475,416, filed Jun. 4, 2003.

BACKGROUND OF THE INVENTION

This invention relates to cooking devices, and in particular to a portable outdoor cooker particularly adapted for boats and convertible for grill, griddle, steam and roast cooking.

It has become increasingly common for boaters and campers to provide and prepare hot food for themselves, their families and guests. It is desirable for boaters and campers to have the capability of grilling, griddling, roasting and steaming various foods and dishes. Because of lack of space and generally cramped quarters, it is generally impossible to bring along enough cooking equipment necessary to accomplish these different cooking tasks.

SUMMARY OF THE INVENTION

The present invention overcomes the limitations of the prior art and provides a single, compact cooking assembly which is portable and has the ability to provide grill, griddle, roast and steam cooking capabilities. The present invention accomplishes this by providing a cooker unit having an open top and a propane gas log interiorly positioned and attached to a propane supply. Various racks and pans and covers are mounted on the cooker providing the ability to grill, griddle, steam or roast. The cooker has removable or retractable legs for mounting on boat rails, a flat surface or the ground.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
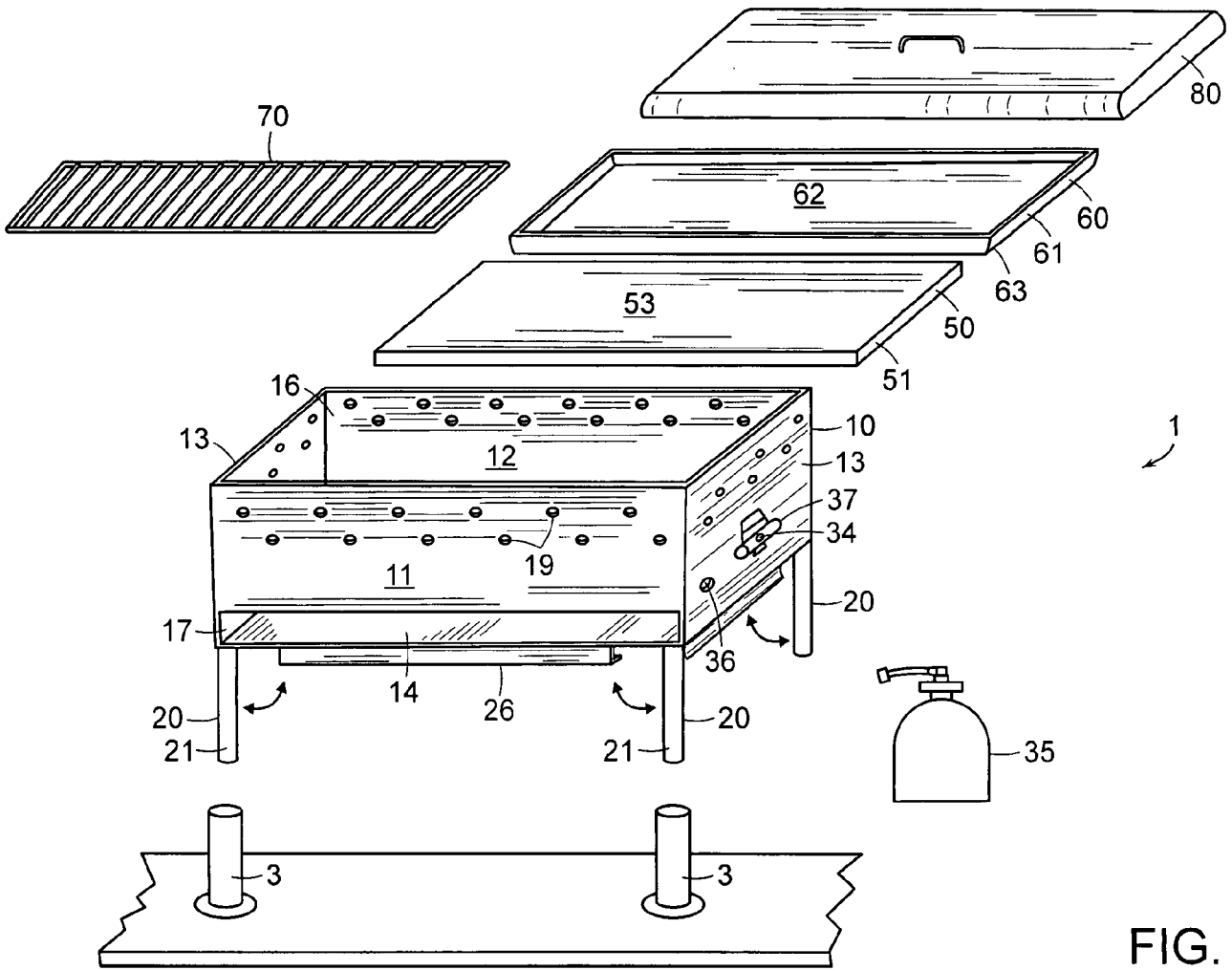
FIG. 1 is a perspective, exploded view of the cooker.
Figure 2:
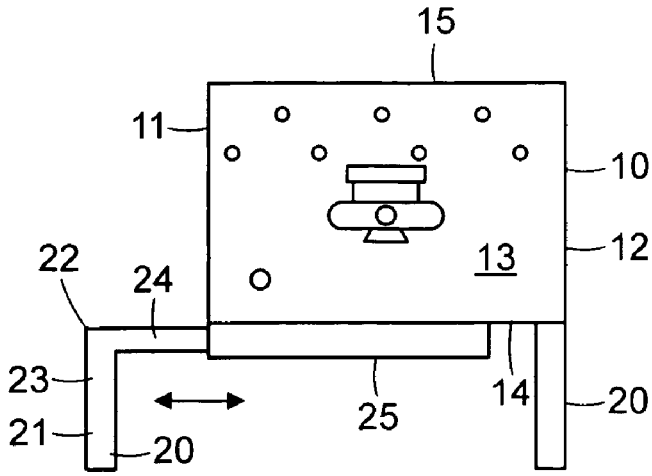
FIG. 2 is a side view of the cooker unit.
Figure 3:
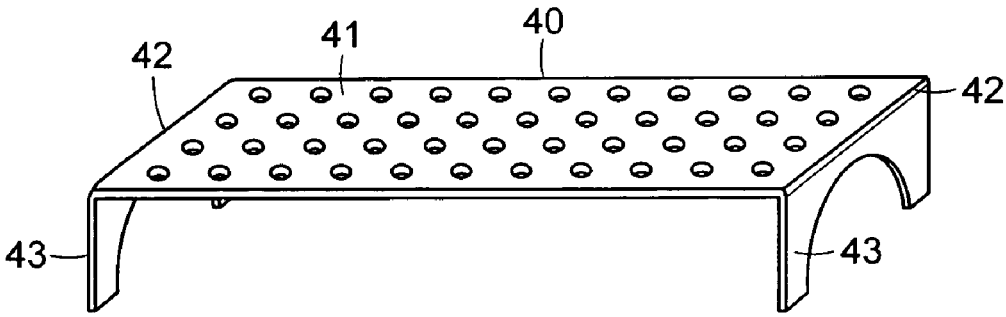
FIG. 3 is a perspective view of diffuser platform.
Figure 4:
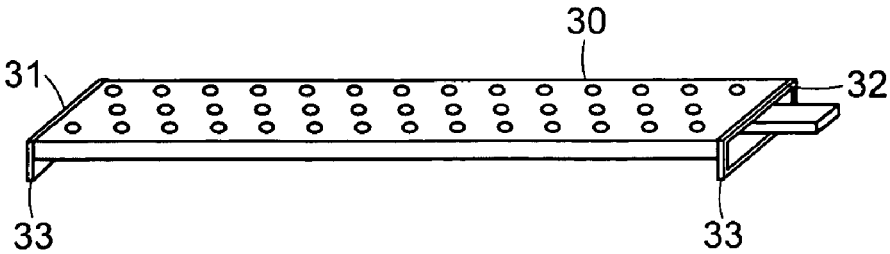
FIG. 4 is a perspective view of the gas log.
Figure 5:
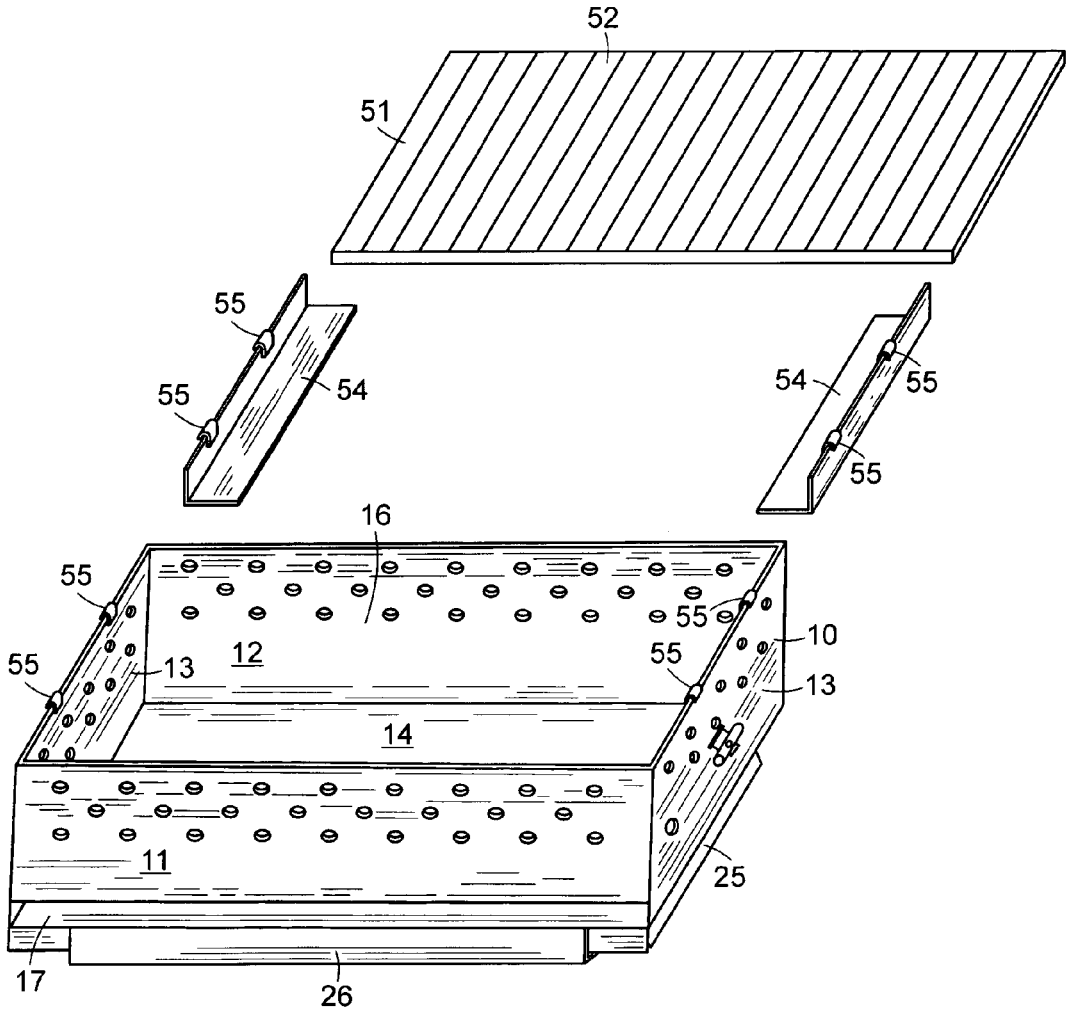
FIG. 5 is a perspective, exploded view of the cooker arranged for grill or griddle cooking.
Figure 6:
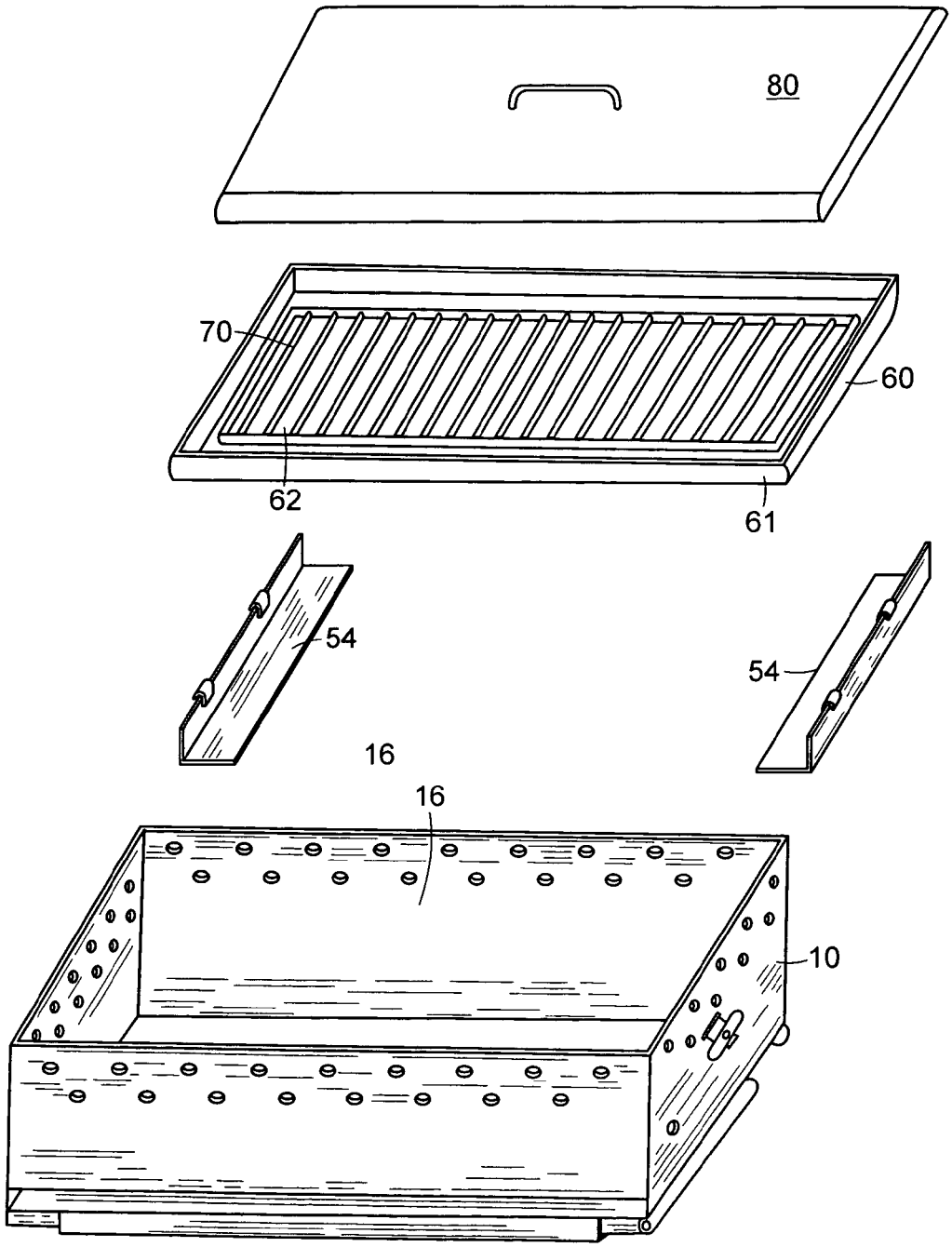
FIG. 6 is a perspective, exploded view of the cooker arranged for roast or steam cooking.

Referring to the drawings in detail wherein like elements are indicated by like numerals, there is shown a convertible portable cooker 1 constructed according to the principles of the present invention. The cooker 1 is comprised of a cooker unit 10, a two-sided grill and griddle unit 50 removably attached to the cooker unit 10, a baking and steaming pan 60 removably attached to the cooker unit 10, a rack 70 insertable into said pan 60, and a cover 80 adapted for removable attachment to the pan 60 or the cooker unit 10.

The cooker unit 10 has a generally rectangular shape with a long sided front 11, an opposite and parallel long sided rear 12, two opposite and parallel short sides 13 interconnecting said front 11 and rear 12, a bottom 14 and an open top 15, said front 11, rear 12, sides 13, bottom 14 and top 15 defining a cooker unit interior 16. The said front 11, rear 12, sides 13, and bottom 14 each have a plurality of perforations 19 formed therein. The sides 13 define a cooker unit longitudinal axis, said longitudinal axis being parallel to the cooker unit front 11 and rear 12. The cooker unit front 11 has an elongated opening 17 formed adjacent the cooker unit bottom 14, said opening 17 extending from one side 13 to the other.

The cooker unit bottom 14 has four downwardly extending legs 20, each located adjacent a junction of side 13 and front 11 and side 13 and rear 12. Each leg 20 is pivotable up toward the cooker unit bottom 14 and adapted for releasable engagement with clips 26 attached to the cooker unit bottom 14 adjacent the cooker unit front 11 and rear 12. The front legs 21 are bent at an approximate midpoint 22 at ninety degree angles into a support portion 23 and an attachment portion 24. The support portion 23 engages the ground or a boat rail holder 3 or similar device. The attachment portion 24 of each front leg 21 is telescopically attached to a tube 25 fixedly attached to the cooker unit bottom 14 adjacent each cooker unit side 13. This permits each front leg 21 to be extended in a forward direction, while still having the front leg support portion engaged in a boat rail holder 3. This provides an additional safety feature of the cooker unit 10. The cooker unit 10 may be moved further away from a boat while still being securely engaged to a boat rail holder 3. For storage, the front leg attachment portions 24 are inserted fully into the holding tubes 25 and the front leg support portions are radially twisted bringing the front leg support portions up to releasable engagement with the holding clips 26 on the cooker unit bottom 14.

The cooker unit 10 is further comprised of a perforated, elongated, hollow, propane gas log 30 with two ends, a first end 31 and a second end 32, said first end 31 and second end 32 defining a gas log longitudinal axis, said gas log longitudinal axis being coincident with the longitudinal axis of the cooker unit 10. Each gas log end 31, 32 has a downwardly extending flange 33. The gas log 30 is positioned within the cooker unit interior 16 so that the gas log flanges 33 removably rests on the cooker unit bottom 14. The gas log second end 32 removably terminates in a propane valve connection 34 inserted into a cooker unit side 13 near to the cooker unit bottom 14. External to the cooker unit 10 is a propane container 35 with appropriate coupling tubing adapted for releasable connection to the propane valve connection 34. A standard ignitor mechanism 36 is fitted into a side wall aperture 37 for easy and safe flame starting.

The cooker unit 10 is further comprised of a diffuser platform 30. The diffuser platform 40 is comprised of a flat, elongated, perforated element 41 having a generally rectangular shape. The perforated element 41 has two short side ends 42 defining a longitudinal axis coincident with the longitudinal axis of the gas log 30 and cooker unit 10. Each perforated element end 42 terminates in a two downwardly projecting support element 43 adapted to removably support the perforated element 41 on the cooker unit bottom 14 over the gas log 30.

The present invention provides a capability for grilling or griddling food items. This is accomplished by means of a two-sided grill and griddle unit 50 comprised of a flat, plate-like, metallic element 51 having two opposite surfaces, a lined surface 52 and a smooth surface 53. The lined surface 52 is the grill surface. The smooth surface 53 serves as the griddle surface. The grill and griddle unit 50 is further comprised of two holding angle irons 54, each removably attached to a cooker unit interior side 13 by a two or more attachment clips 55. The angle irons 54 are attached to the cooker interior sides 13 and the grill and griddle unit 50 set onto the angle irons 54 with the desired side, 52 or 53, face up. Diffused heat from the gas log 30 through the diffuser platform heats the grill and griddle unit 50 providing a cooking surface to a user. The grill and griddle unit 50 is preferably made from a cast aluminum with a non-stick material coating.

The present invention also provides a capability for roasting and steaming food. This is accomplished by means of a baking and steaming pan 60 removably attached to the cooker unit 10, a rack 70 insertable into said pan 60, and a cover 80 adapted for removable attachment to the pan 60 or the cooker unit 10. The baking and steaming pan 60 is a generally rectangular, standard restaurant pan which has an outer surface 61 and an interior 62. The pan 60 is inserted through the cooker unit top 15 into the cooker unit interior 16 and rests on the on the angle irons 54 attached to the cooker unit interior sides 13. The invention is further comprised of a rack 70 which is insertable into the pan interior 62. The invention further provides a cover 80 which fits over the pan 60 in a snug fit. For steam cooking a desired amount of water is placed into the pan interior 62, the food items placed on the rack 70 and the cover 80 placed over the pan 60. For roasting the same process is followed as for steam cooking, except water is omitted.

Figure 7:
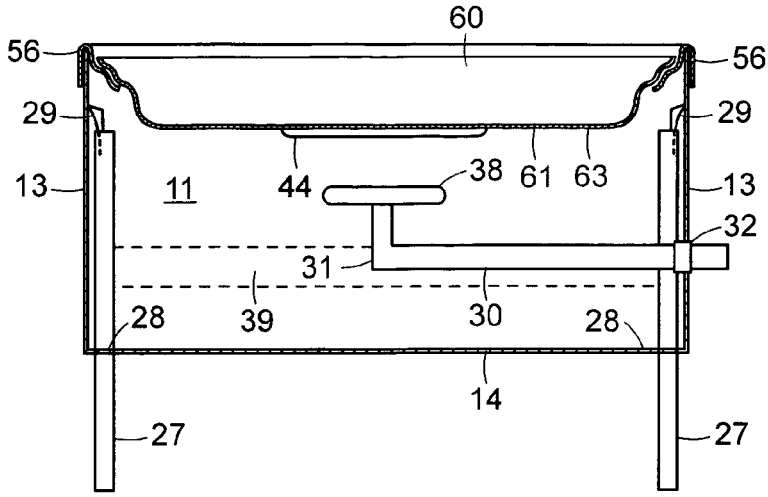
FIG. 7 is a cross sectional rear view of a cooker unit alternate embodiment.

In an alternate embodiment of the invention, the diffuser platform 40 is eliminated. In lieu of the diffuser 40, a shield 44 is tack welded to the exterior surface bottom 63 of the baking and steaming pan 60. See FIG. 7.

Figure 8:
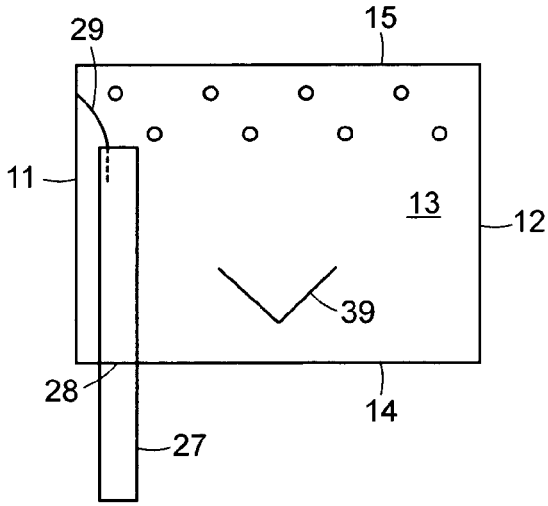
FIG. 8 is a cross sectional side view of the embodiment shown in FIG. 7.

In another alternate embodiment of the invention, the gas log 30 is a hollow gas tube with first end 31 terminating in an upwardly projecting gas burner 38. The gas log second end 32 is connected to the propane valve connection 34 inserted into a cooker unit side 13. The gas log flanges 33 may stay in place or may be replace with a "V" shaped holder 39 attached to and interconnecting the cooker unit sides 13, said holder 39 being suspended above the cooker unit bottom 14. See FIGS. 7 and 8.

In another alternate embodiment of the invention, the four, previously described downwardly extending legs 20 are replaced with two or four straight, removable legs 27. An aperture 28 is formed in the corners of the cooker unit bottom 14 adjacent each side 13 and front 11 and rear 12. A clip 29 is attached to the front 11 adjacent each side 13. A clip 29 may also be attached to the rear 12 adjacent each side 13. Each desired leg 27 is inserted through a cooker unit bottom aperture 28 into the cooker unit interior 16 wherein the leg is engaged by a clip 29 holding the leg 27 in position. The remainder of the leg 27 protrudes out of the cooker bottom 14 a desired length. See FIGS. 7 and 8.

Figure 9:
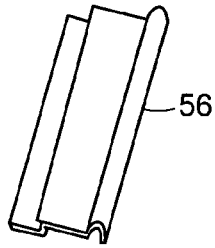
FIG. 9 is a top perspective view of a holding bar.

The attachment clips 55 of the previously described embodiment may be replaced with holding bars 56 attachable to the top 15 of the sides 13 thereby allowing the grill and griddle unit 50 and baking and steaming pan 60 to be held firmly in place within the cooker unit interior 16. The cover 80 may be used over either the grill and griddle unit 50 or baking and steaming pan 60. See FIGS. 7, 8 and 9.

The advantage of the present invention is the variety of cooking options offered despite the compactness of the invention. The cooker unit 10 is preferably made from stainless steel. The two-sided grill and griddle unit 50, baking and steaming pan 60, and cover 80 are also preferably made from stainless steel with a coating of Teflon or other non-stick surface. However, other materials with comparable performance characteristics may also be used.

It is understood that the above-described embodiment is merely illustrative of the application. Other embodiments may be readily devised by those skilled in the art which will embody the principles of the invention and fall within the spirit and scope thereof.

I claim:

1. A convertible portable cooker mountable on a boat railing and convertible for grill, griddle, steam and roast cooking, comprising:

a cooker unit having an open top and a propane gas log interiorly positioned and attached to an exterior propane supply, and a plurality of legs adapted for mounting on said boat rail, wherein the cooker unit has a generally rectangular shape with a long sided front, an opposite and parallel long sided rear, two opposite and parallel short sides interconnecting said front and rear, a bottom and an open top, said front, rear, sides, bottom and top defining a cooker unit interior, said sides defining a cooker unit longitudinal axis, said longitudinal axis being parallel to the cooker unit front and rear, said cooker unit front having an elongated opening formed adjacent the cooker unit bottom, said opening extending from one side to the other side;

wherein said plurality of legs are comprised of four elongated and downwardly extending legs, each leg located adjacent a junction of side and front and side and rear, each said leg being pivotable up toward the cooker unit bottom and adapted for releasable engagement with clips attached to the cooker unit bottom adjacent the cooker unit front and rear, said legs located at the side and front being bent at an approximate midpoint at ninety degree angles into a support portion and an attachment portion, said support portions engaging a boat rail holder, said attachment portions being telescopically attached to a holding tube fixedly attached to the cooker unit bottom adjacent each cooker unit side, said front leg attachment portions adapted to being inserted fully into the holding tubes and the front leg support portions radially twisted bringing the front leg support portions up to releasable engagement with the holding clips on the cooker unit bottom;

a two-sided grill and griddle unit removably attached to the cooker unit;

a baking and steaming pan removably attached to the cooker unit;

a rack insertable into said pan; and a cover adapted for removable attachment to the pan and the cooker unit.

* * * * *